US006099420A

United States Patent [19]

Nandra

[11] Patent Number: 6,099,420

[45] Date of Patent: Aug. 8, 2000

[54] PORTABLE HOCKEY PRACTICE SYSTEM

[76] Inventor: Mukhtar S. Nandra, 103-8$^{th}$ Ave., SW., Crosby, N. Dak. 58730

[21] Appl. No.: 09/172,111

[22] Filed: Oct. 13, 1998

[51] Int. Cl.$^{7}$ ..... A63B 67/04

[52] U.S. Cl. ..... 473/446

[58] Field of Search ..... 473/446, 132

[56] References Cited

U.S. PATENT DOCUMENTS

| | | | |
|---|---|---|---|
| 3,955,815 | 5/1976 | Deschesnes | 473/446 |
| 4,070,017 | 1/1978 | Lombardi | 473/446 |
| 5,161,799 | 11/1992 | Nandra | 473/446 |

*Primary Examiner*—Mark S. Graham
*Attorney, Agent, or Firm*—Michael S. Neustel

[57] ABSTRACT

A portable hockey practice system for increasing a hockey player's skill in shooting and catching a hockey puck along with developing quicker and better reflexes. The inventive device preferably includes three track sections each having a slot, a plurality of connecting members that connect the three track sections with conventional fasteners, a first end plate and a second end plate at opposing ends of the connected track sections, a first spring and a second spring attached to opposing end plates, and a puck attached to spacer slidably positioned within the slot of the connected track sections. The user engages the puck with a conventional hockey stick driving the puck towards the first spring. The first spring rebounds the puck towards the user. The user has the option of either catching the puck or letting the puck pass through where after it engages the second spring that rebounds the puck back to the user to stop with their back hand motion. The user can adjust the velocity of the puck rebounding from the first spring by adjusting the adjusting bolt that retains the first spring semi-compressed.

15 Claims, 4 Drawing Sheets

PORTABLE HOCKEY PRACTICE SYSTEM

BACKGROUND OF THE INVENTION

1. Field of the Invention

The present invention relates generally to sport practice devices and more specifically it relates to a portable hockey practice system for increasing a hockey player's skill in shooting and catching a hockey puck along with developing quicker and better reflexes.

2. Description of the Prior Art

Sport practice devices have been in use for years. Typically, the invention will utilize a net assembly with pockets within that the hockey player must shoot the puck at.

The problem with the prior art is that it does not provide a system for sharpening the player's skills for catching the hockey puck. Additionally, the player must walk to the net and retrieve the hockey puck after shooting which can be time consuming.

While these devices may be suitable for the particular purpose to which they address, they are not as suitable for increasing a hockey player's skills in shooting and catching a hockey puck. The prior art only teaches a system of shooting the hockey puck and not a system for catching the hockey puck.

In these respects, the portable hockey practice system according to the present invention substantially departs from the conventional concepts and designs of the prior art, and in so doing provides an apparatus primarily developed for the purpose of increasing a hockey player's skills in shooting and catching a hockey puck.

SUMMARY OF THE INVENTION

A primary object of the present invention is to provide a portable hockey practice system that will overcome the shortcomings of the prior art devices.

Another object is to provide a portable hockey practice system that is portable.

An additional object is to provide a portable hockey practice system that is lightweight.

A further object is to provide a portable hockey practice system that is capable of being disassembled into a compact storage space.

Another object is to provide a portable hockey practice system that increases a hockey player's shooting skills and strength.

Another object is to provide a portable hockey practice system that increases a hockey player's catching skills and strength.

Still another object is to provide a portable hockey practice system that allows the user to adjust the speed of the puck coming back to him or her after shooting.

Another object is to provide a portable hockey practice system that develops better and quicker reflexes.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

The present invention is for increasing a hockey player's skills in shooting and catching a hockey puck. The present invention preferably comprises three track sections each having a slot, a plurality of connecting members that connect the three track sections with conventional fasteners, a first end plate and a second end plate at opposing ends of the connected track sections, a first spring and a second spring attached to opposing end plates, and a puck attached to spacer slidably positioned within the slot of the connected track sections. The user engages the puck with a conventional hockey stick driving the puck towards the first spring. The first spring rebounds the puck towards the user. The user has the option of either catching the puck or letting the puck pass through where after it engages the second spring that rebounds the puck back to the user to stop with his back hand motion. The user can adjust the velocity of the puck rebounding from the first spring by adjusting the adjusting bolt that retains the first spring semi-compressed.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
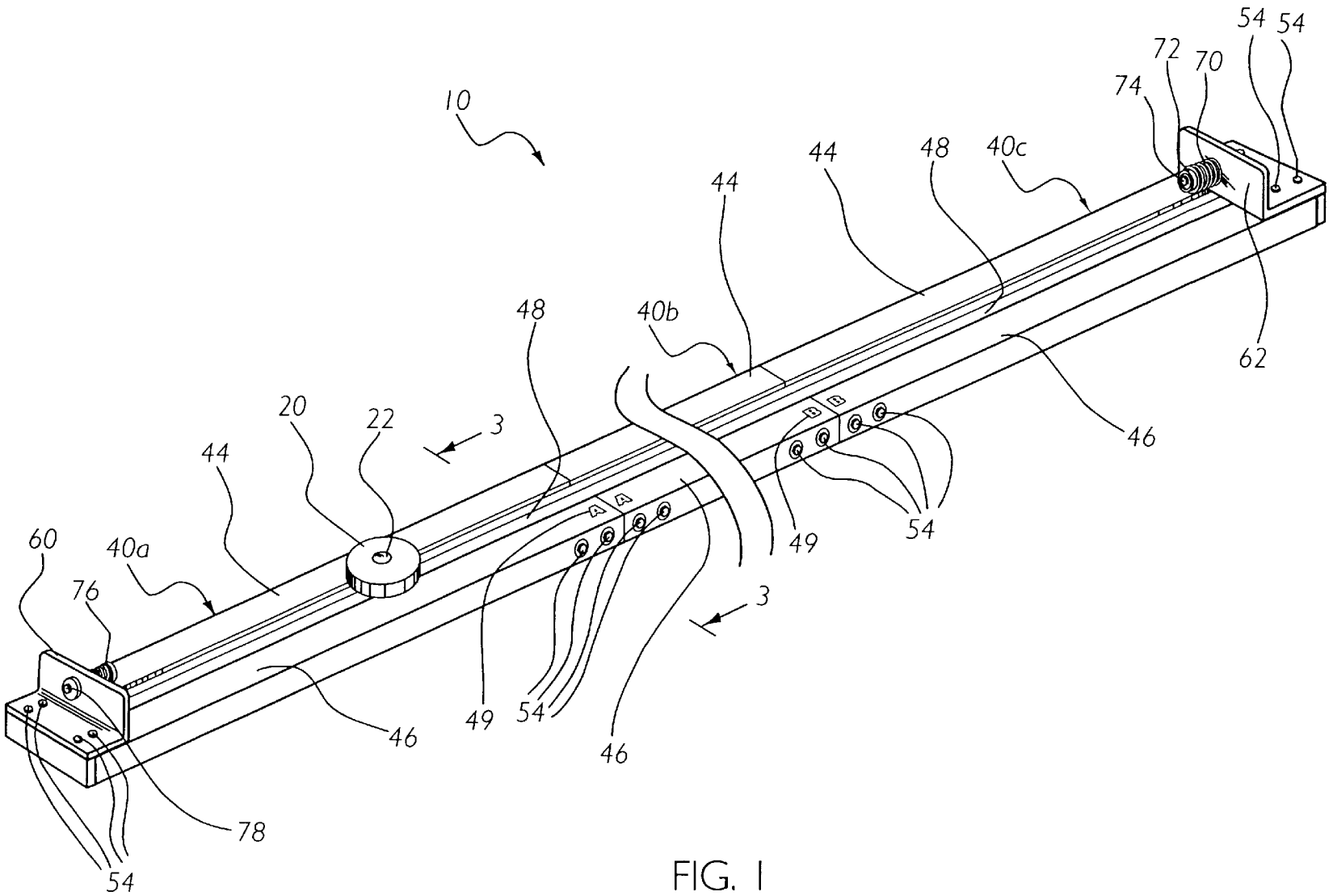
FIG. 1 is an upper perspective view of the present invention.

Turning now descriptively to the drawings, in which similar reference characters denote similar elements throughout the several view, FIGS. 1 through 5 illustrate a portable hockey practice system 10, which preferably comprises three track sections 40*a–c* each having a slot 48, a plurality of connecting members 50*a–b* that connect the three track sections 40*a–c* with conventional fasteners 54, a first end plate 60 and a second end plate 62 at opposing ends of the connected track sections 40*a–c*, a first spring 70 and a second spring 76 attached to opposing end plates 60, 62, and a puck 20 attached to spacer 30 slidably positioned within the slot 48 of the connected track sections 40*a–c*. The user engages the puck 20 with a conventional hockey stick driving the puck 20 towards the first spring 70. The first spring 70 rebounds the puck 20 towards the user. The user has the option of either catching the puck 20 or letting the puck 20 pass through where after it engages the second spring 76 that rebounds the puck 20 back to the user to stop with their back hand motion. The user can adjust the velocity of the puck 20 rebounding from the first spring 70 by adjusting the adjusting bolt 74 that retains the first spring 70 semi-compressed.

As shown in FIG. 1, the slot 48 of track sections 40*a–c* are aligned when the track sections 40*a–c* are interconnected. The track sections 40*a–c* are preferably constructed from a lightweight material such as aluminum, however it can be appreciated that various other well-known types of materials may be utilized. The preferred method of constructing the track sections 40*a–c* is by conventional extrusion methods, however other well-known methods may be utilized. After a length of track 40 has been extruded, the track 40 is cut in two places forming three track sections 40*a–c*. Immediately after or before the track 40 is cut into three track sections 40*a–c*, alignment indicia 49 are positioned upon both sides of the cut to insure that during assembly the proper sections 40*a–c* and their respective ends are connected to provide a near perfect alignment of the three track sections 40*a–c* as the track 40 was prior to cutting.

Figure 3:
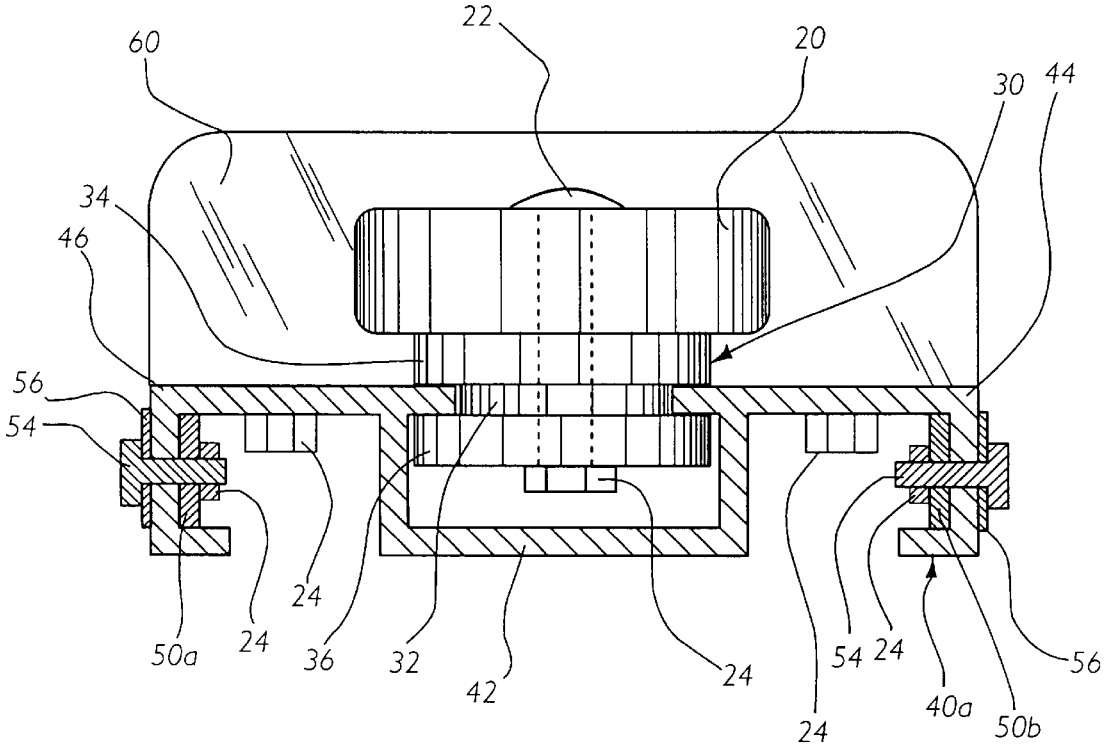
FIG. 3 is a cross-sectional view taken along line 3—3 of FIG. 1.
Figure 4:
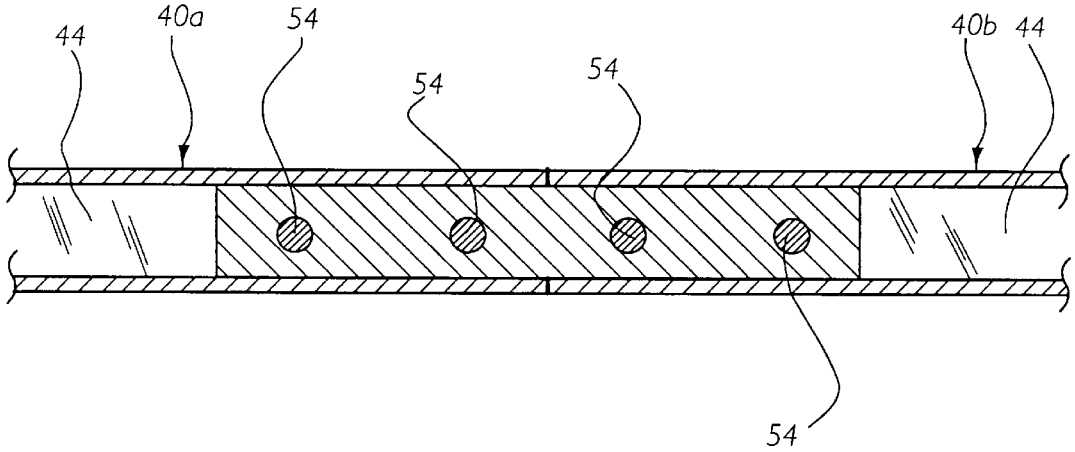
FIG. 4 is a cross-sectional view taken along line 4—4 of FIG. 2.

As best shown in FIG. 3 of the drawings, each of the track sections 40*a–c* have a U-shaped portion 42 with a first wing portion 44 and a second wing portion 46 extending therefrom. The distal ends of the wing portions 44, 46 and the bottom surface of the U-shaped portion 42 support the track sections 40*a–c* during use. There is preferably a slot 48 between the wing portions 44, 46 exposing the interior portion of the U-shaped portion 42 of the track sections 40*a–c*. The wing portions 44, 46 have a side-ways L-shape with the longitudinal portion substantially horizontal. The traverse portion of the wing portions 44, 46 have a lower lip as shown in FIG. 3 of the drawings.

As best shown in FIG. 3, a spacer 30 is slidably positioned within the slot 48 of the track sections 40*a–c*. The spacer 30 is preferably cylindrical shaped, however it may be formed into any other acceptable shape. The spacer 30 is constructed of conventional materials such as plastic or other suitable wear resistant material. The spacer 30 is preferably a self-lubricating plastic bearing wherein the plastic material provides a low track resistance. The spacer 30 includes a perimeter groove 32 within the central portion of the perimeter that slidably receives the edge of the wing portions 44, 46 as shown in FIG. 3 of the drawings. The perimeter groove 32 forms an upper flange 34 and a lower flange 36 for the spacer 30 that retain the spacer 30 within the slot 48 of the track sections 40*a–c* during use.

As shown in FIGS. 1 and 3 of the drawings, an axle 22 extends through the puck 20 and then through the spacer 30. A nut 24 is secured to the threaded end portion of the axle 22 for retaining the puck 20 in attachment to the spacer 30, thereby slightly elevating the puck 20 a finite distance above the upper surface of the track sections 40*a–c*. The puck 20 may be rotatably attached to the spacer 30 or non-movably attached to the spacer 30. The puck 20 is preferably constructed from hardened rubber, however other conventional materials may be utilized.

Figure 2:
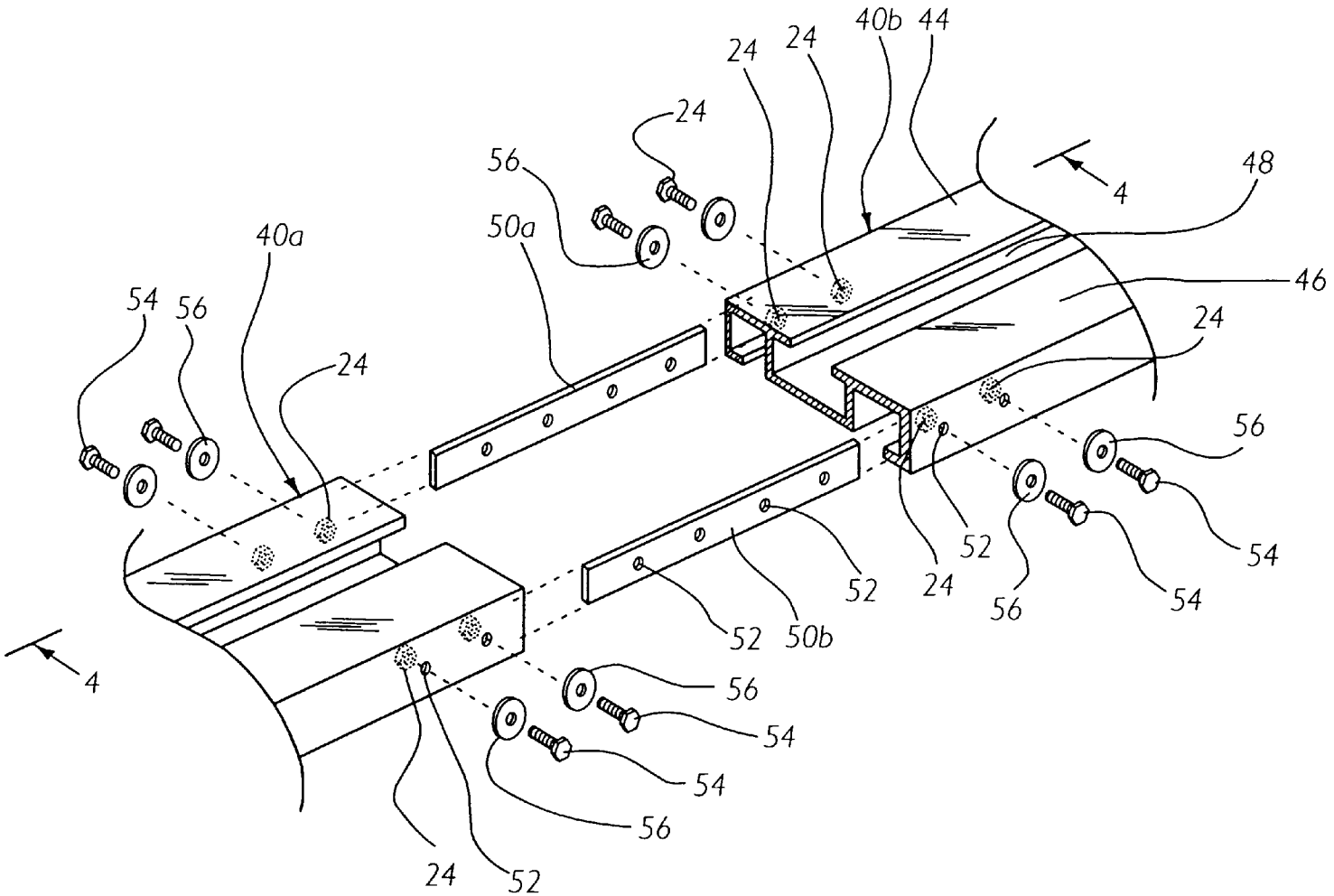
FIG. 2 is a magnified exploded upper perspective view of the track sections and the connecting members.

As best shown in FIG. 2 of the drawings, a pair of connecting members 50*a–b* are positioned between each connection of the track sections 40*a–c*. The connecting members 50*a–b* are preferably of an elongated structure with a rectangular cross-sectional area, however it can be appreciated by one skilled in the art that various other cross-sectional shapes may be utilized. The connecting members 50*a–b* each have a plurality of apertures 52 within that correspond with apertures 52 within the sides of the track sections 40*a–c*. Conventional fasteners 54 are insertable through the apertures 52 with a washer 56 attached within the head portion of the fasteners 54 and a nut 24 threadably attached to each of the fasteners 54 to retain the track sections 40*a–c* interconnected. As shown in FIG. 3, the connecting members 50*a–b* are adjacent the inner sides and the lower lip of the track sections 40*a–c*. The lower lip assists in supporting the vertical forces encountered by the connecting members 50*a–b* and fasteners 54 during operation of the invention.

Figure 5:
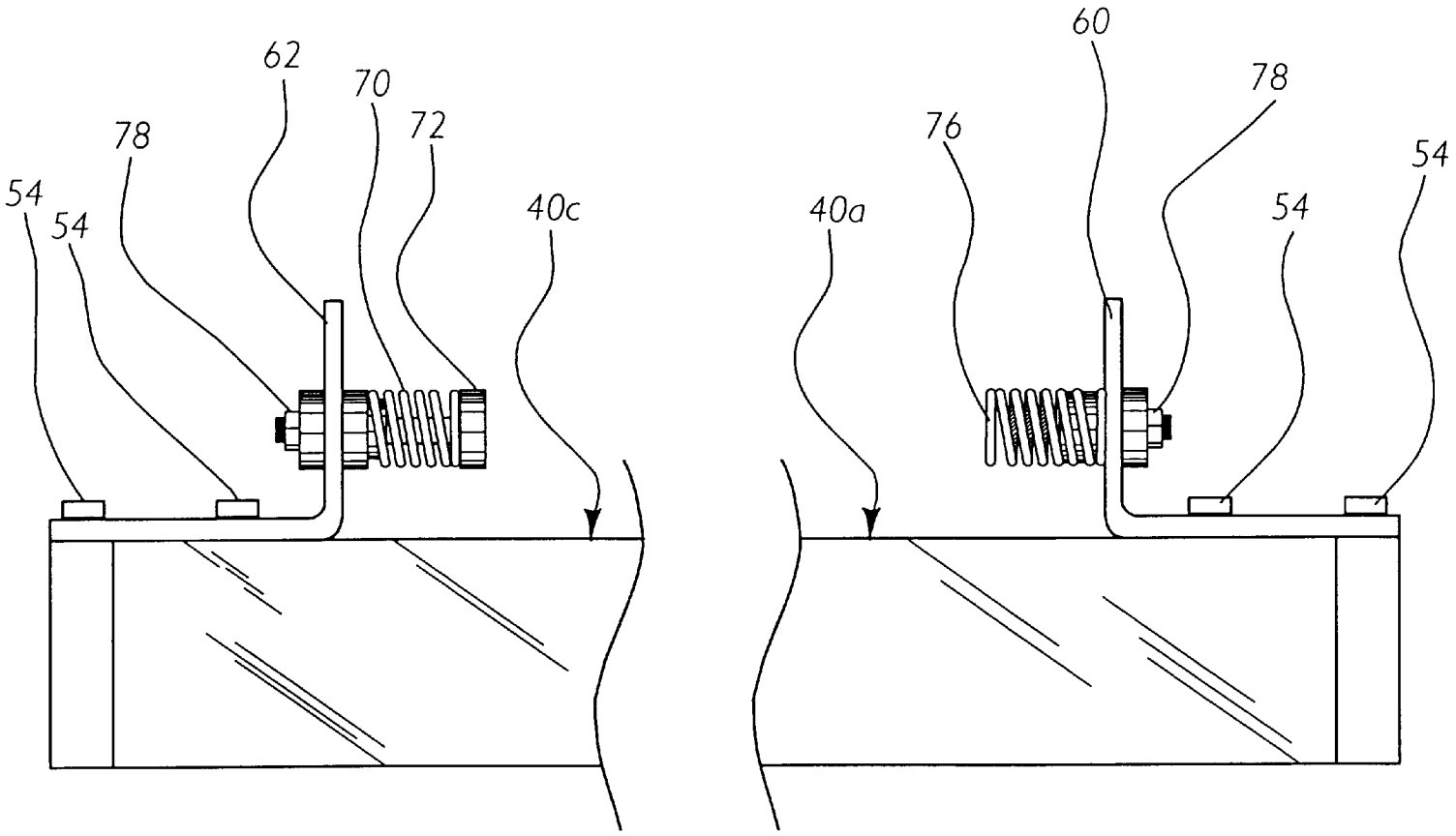
FIG. 5 is a side view of the present invention disclosing the opposing pair of springs.

As shown in FIGS. 1 and 5 of the drawings, a first end plate 60 is attached to a distal end of the track sections 40*a–c* by a plurality of fasteners 54. Additionally, a second end plate 62 is attached to the opposing end of the track sections 40*a–c* by a plurality of fasteners 54. The end plates 60, 62 are formed into an L-shape and are constructed from conventional materials such as metal.

As shown in FIGS. 1 and 5 of the drawings, a first spring 70 is attached to the second end plate 62 by an adjusting bolt 74. The adjusting bolt 74 extends through the second end plate 62 through the first spring 70 thereafter in engagement with a retainer 72 positioned at the end of the first spring 70. The retainer 72 protects the first spring 70 from damage during extensive use by the hockey player. The user adjusts the compression of the first spring 70 to the desired level by adjusting the adjusting bolt 74 to the desired position. The adjustment of the first spring 70 determines how fast the rebound velocity will be from the first spring 70.

As shown in FIGS. 1 and 5 of the drawings, a second spring 76 is attached to the first end plate 60 by a retaining bolt 78. The retaining bolt 78 secures a cylindrical body within the second spring 76 thereby retaining the spring attached to the first end plate 60.

In use, the user adjusts the first spring 70 to the desired compression. The user then hits the puck 20 with a conventional hockey stick towards the first spring 70. The puck 20 and the spacer 30 slide along the slot 48 within the track sections 40*a–c* until the puck 20 engages the retainer 72 of the first spring 70. The first spring 70 compresses and then rebounds the puck 20 back towards the user. The user then has two choices: (1) he can catch the puck 20 with his forehand motion, or (2) he can let the puck 20 pass through to engage the second spring 76 and the catch the puck 20 with his backhand motion. The user continues the above stated process until finished utilizing the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

ENVIRONMENTAL ELEMENTS

10. Portable Hockey Practice System
11.
12.
13.
14.
15.
16.
17.
18.
19.
20. Puck

21.
22. Axle
23.
24. Nut
25.
26.
27.
28.
29.
30. Spacer
31.
32. Perimeter Groove
33.
34. Upper Flange
35.
36. Lower Flange
37.
38.
39.
40. Track Sections (a, b & c)
41.
42. U-Shaped Portion
43.
44. First Wing Portion
45.
46. Second Wing Portion
47.
48. Slot
49. Alignment Indicia
50. Connecting Members (a–b)
51.
52. Apertures
53.
54. Fasteners
55.
56. Washers
57.
58.
59.
60. First End Plate
61.
62. Second End Plate
63.
64.
65.
66.
67.
68.
69.
70. First Spring
71.
72. Retainer
73.
74. Adjusting Bolt
75.
76. Second Spring
77.
78. Retaining Bolt
79.

I claim:

1. A portable hockey practice system comprising:

at least two track sections having a corresponding slot along a longitudinal axis;

a connecting means between said at least two tracks sections for allowing selective connecting of said at least two track sections;

a puck slidably attached within said slot by a sliding means;

a first spring means attached to a distal end of said at least two track sections; and a second spring means attached to said at least two track sections opposite of said first spring means.

2. The portable hockey practice system of claim 1, wherein said at least two track sections each comprise:

a U-shaped portion;

a first wing portion attached to said U-shaped portion; and a second wing portion attached to said U-shaped portion opposite of said first wing portion.

3. The portable hockey practice system of claim 1, wherein said connecting means comprises:

a pair of connecting members; and a plurality of apertures within said pair of connecting members corresponding with a plurality of apertures within said at least two track sections that receive a corresponding number of conventional fasteners for retaining said at least two track sections together.

4. The portable hockey practice system of claim 1, wherein said sliding means comprises a spacer slidably positioned within said slot.

5. The portable hockey practice system of claim 1, wherein said first spring means comprises:

a second end plate;

a first spring attached to said second end plate by an adjusting bolt; and a retainer attached to a distal end of said first spring.

6. The portable hockey practice system of claim 5, wherein a user is able to adjust a compression of said first spring by adjusting said adjusting bolt.

7. The portable hockey practice system of claim 1, wherein said second spring means comprises:

a first end plate; and a second spring attached to said first end plate by a retaining bolt.

8. The portable hockey practice system of claim 4, wherein said puck is rotatably attached to said spacer.

9. The portable hockey practice system of claim 4, wherein said spacer comprises a perimeter groove forming an upper flange and a lower flange.

10. The portable hockey practice system of claim 9, wherein said first spring means comprises:

a second end plate;

a first spring attached to said second end plate by an adjusting bolt; and a retainer attached to a distal end of said first spring.

11. The portable hockey practice system of claim 10, wherein a user is able to adjust a compression of said first spring by adjusting said adjusting bolt.

12. The portable hockey practice system of claim 11, wherein said second spring means comprises:

a first end plate; and a second spring attached to said first end plate by a retaining bolt.

13. A portable hockey practice system comprising:

a track section having a slot along a longitudinal axis of said track section;

a puck slidably attached within said slot by a sliding means;

a first spring means attached to a distal end of said track section; and a second spring means attached to an opposing distal end of said track section.

14. The portable hockey practice system of claim 13, wherein first spring means is adjustable.

15. The portable hockey practice system of claim 14, wherein said first spring means comprises:

an end plate;

a first spring attached to said end plate by an adjusting bolt; and a retainer attached to a distal end of said first spring.

* * * * *